US005377728A

United States Patent [19]

McLeighton

[11] Patent Number: 5,377,728

[45] Date of Patent: Jan. 3, 1995

[54] OIL FUNNEL WITH FILTER SYSTEM

[76] Inventor: Kevin L. McLeighton, 1602 Laramie, Marysville, Kans. 66508

[21] Appl. No.: 115,578

[22] Filed: Sep. 3, 1993

[51] Int. Cl.[6] ..... B65B 39/00

[52] U.S. Cl. ..... 141/333; 141/98; 141/331; 141/340; 141/339; 210/314; 210/477

[58] Field of Search ..... 141/333, 334, 98, 331, 141/339–342; 210/314, 323.1, 474, 477, 484

[56] References Cited

U.S. PATENT DOCUMENTS

| | | | |
|---|---|---|---|
| 402,379 | 4/1889 | Xander et al. | 141/333 X |
| 426,911 | 4/1890 | Burke | 210/314 X |
| 1,351,293 | 8/1920 | Leech | 210/314 X |
| 1,383,479 | 7/1921 | Nugent | 210/314 X |
| 1,524,547 | 1/1925 | Giacobbe | 210/477 X |
| 1,644,837 | 10/1927 | Johnson | 141/339 |
| 1,655,021 | 1/1928 | Nord | 141/333 |
| 1,910,774 | 5/1933 | Saunders | 210/474 X |
| 2,101,770 | 12/1937 | Wolfe | 210/314 |
| 2,144,923 | 1/1939 | Kester et al. | 141/334 |
| 3,271,937 | 9/1966 | Stripp | 210/314 X |
| 5,033,520 | 7/1991 | Kuehmichel | 141/333 X |
| 5,117,878 | 6/1991 | Shaw et al. | 141/333 |

FOREIGN PATENT DOCUMENTS

| | | | |
|---|---|---|---|
| 0014303 | 11/1911 | France | 141/331 |
| 0469841 | 8/1914 | France | 141/331 |

*Primary Examiner*—J. Casimer Jacyna
*Attorney, Agent, or Firm*—Hugh E. Smith

[57] ABSTRACT

Apparatus for funneling waste into a drum containing four trapezoidal sidewalls. The four trapezoidal sidewalls coupled to form a non-symmetric truncated pyramid having a vertical axis. A drain pipe having a circular cross-section with a vertical axis that is coincident with the axis of the pyramid. The drain pipe has external threads for coupling with a drum. A coupling plate is coupled to the pyramid. Four rectangular sidewalls are coupled to the truncated sidewalls to form an upper extension of the pyramid. Vertically extending supports depend from the apparatus sidewall that has notches to position over the peripheral flange of a drum. A filter is supported within the apparatus.

2 Claims, 4 Drawing Sheets

OIL FUNNEL WITH FILTER SYSTEM

BACKGROUND OF THE INVENTION

1. Field of the Invention

The present invention relates to an oil funnel with filtering system and more particularly pertains to a funnel for waste oil with a removable filter located therein.

2. Description of the Prior Art

The use of oil funnels is known in the prior art. More specifically, funnels heretofore devised and utilized for the purpose of pouring waste oil in drums are known to consist basically of familiar, expected and obvious structural configurations, notwithstanding the myriad of designs encompassed by the crowded prior art which have been developed for the fulfillment of countless objectives and requirements.

The prior art discloses various approaches for funneling fluids. By way of example, U.S. Pat. No. 4,706,7202 Pattison discloses a funnel with sealing members for preventing contamination during non use.

U.S. Pat. No. 4,913,201 Lucero discloses a liquid funnel which alleges a no-hyphen drip configuration due to the shape of the device.

U.S. Pat. No. 4,112,9842 Quglia discloses a funnel designed specifically for openings in the fuel tanks of vehicles.

U.S. Pat. No. 4,789,017 Panasewicz relates to a funnel with an internal storage system.

U.S. Pat. No. 5,018,559 Branan relates a funnel specifically designed for use with a standard 55 gallon drum and with a hinged lid fastener.

In this respect, the funnel according to the present invention substantially departs from the conventional concepts and designs of the prior art, and in so doing provides an apparatus primarily developed for the purpose of funnelling waste oil and filtering it during the funneling operation.

Therefore, it can be appreciated that there exists a continuing need for new and improved funnels with filters which can be used for storing waste oil. In this regard, the present invention substantially fulfills this need.

SUMMARY OF THE INVENTION

In view of the foregoing disadvantages inherent in the known types of oil funnels now present in the prior art, the present invention provides an improved funnel construction wherein the same can be used for also filtering out particulate matter. As such, the general purpose of the present invention, which will be described subsequently in greater detail, is to provide a new and improved oil funnel with filter system apparatus and method which has all the advantages of the prior art funnels and none of the disadvantages.

To attain this, the present invention essentially comprises a new and improved apparatus for funneling waste oil into a 55 gallon drum and for filtering particulant matter from such oil comprising, in combination, four trapezoidal sidewalls, each trapezoidal sidewall having an upper edge, a lower edge and side edges, two opposed trapezoidal sidewalls being of a similar configuration, the remaining two opposed trapezoidal sidewalls constituting a large trapezoidal sidewall and a small trapezoidal sidewall, means coupling the side edges of the four trapezoidal sidewalls to form a nonsymmetric truncated pyramid having a vertical axis; a drain pipe having a circular cross-section with a vertical axis coincident with the axis of the pyramid, the drain pipe having a lower end with external threads for coupling with an opening of a 55 gallon drum, the drain pipe having an upper end; a coupling plate having a circular opening in the center thereof with means coupling the opening to the upper end of the drain pipe, the coupling plate having a rectangular periphery with means coupling the periphery to the lower edges of the pyramid; four rectangular sidewalls, each rectangular sidewall having an upper edge, a lower edge and side edges, two opposed rectangular side walls being of a similar configuration, the remaining two opposed rectangular sidewalls constituting a large rectangular sidewall and a small rectangular sidewall with means coupling the lower edges of the four rectangular sidewalls to the upper edges of the truncated sidewalls and means coupling the side edges of the four rectangular sidewalls to thereby form an upper extension of the pyramid; a the side walls of the upper extension adjacent to vertically extending support rods coupled to and depending from a region of the large trapezoidal sidewall remote from the drain pipe, the lower edge of the support rods terminating in notches for positioning over the peripheral flange of a 55 gallon drum, the notches being located at an elevational location above the threads at the lower end of the drain pipe; a screen removable received within the apparatus to filter out particulant matter poured through the filter into the 55 gallon drum.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved oil funnel with filter system which has all the advantages of the prior art funnels and none of the disadvantages.

It is another object of the present invention to provide a new and improved oil funnel with filter system which may be easily and efficiently manufactured and marketed.

It is a further object of the present invention to provide a new and improved oil funnel with filter system which is of a durable and reliable construction.

An even further object of the present invention is to provide a new and improved oil funnel with filter system which is susceptible of a low cost of manufacture with regard to both materials and labor, and which accordingly is then susceptible of low prices of sale to the consuming public, thereby making such funnels economically available to the buying public.

Still yet another object of the present invention is to provide a new and improved oil funnel with filter system which provides in the apparatuses and methods of the prior art some of the advantages thereof, while simultaneously overcoming some of the disadvantages normally associated therewith.

Still another object of the present invention is to funnel waste oil into an oil drum while concurrently filtering such oil.

Yet another object of the present invention is to filter oil as it is being funneled into a drum.

Even still another object of the present invention is to store waste oil while funneling it for precluding loss and filtering it for increasing its purity.

Lastly it is an object of the present invention to provide an apparatus for funneling waste oil into a drum and for filtering particulant matter from such oil comprising, in combination, four trapezoidal sidewalls, each trapezoidal sidewall having an upper edge, a lower edge and side edges, two opposed trapezoidal sidewalls being of a similar configuration, the remaining two opposed trapezoidal sidewalls constituting a large trapezoidal sidewall and a small trapezoidal sidewall, the side edges of the four trapezoidal sidewalls coupled to form a non-symmetric truncated pyramid having a vertical axis; a drain pipe having a circular cross-section with a vertical axis coincident with the axis of the pyramid, the drain pipe having a lower end with external threads for coupling with an opening of a drum, the drain pipe having an upper end; a coupling plate having a circular opening in the center thereof with means coupling the opening to the upper end of the drain pipe, the coupling plate having a rectangular periphery coupled to the lower edges of the pyramid; four rectangular sidewalls, each rectangular sidewall having an upper edge, a lower edge and side edges, two opposed rectangular side walls being of a similar configuration, the remaining two opposed rectangular sidewalls constituting a large rectangular sidewall and a small rectangular sidewall with the lower edges of the four rectangular sidewalls coupled to the upper edges of the truncated sidewalls and the side edges of the four rectangular sidewalls coupled to thereby form an upper extension of the pyramid; and vertically extending support means depending from the apparatus sidewall notches for positioning over the peripheral flange of a drum; and a filter supported within the apparatus.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
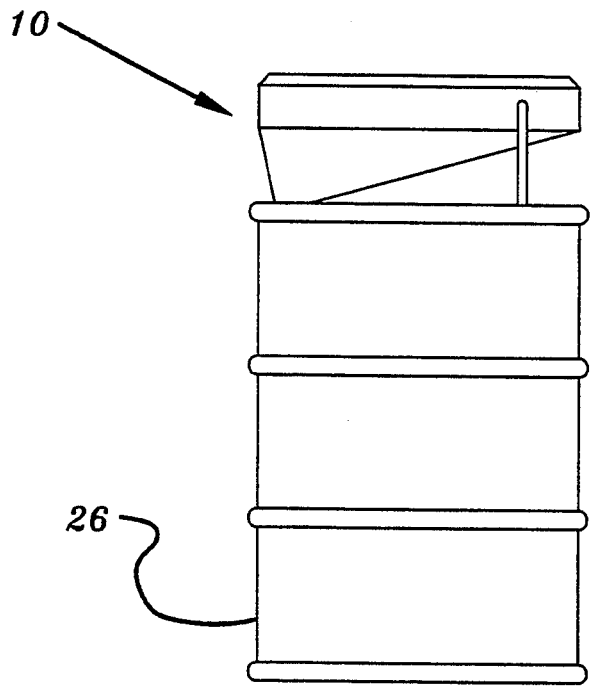
FIG. 1 is an elevational view of the oil funnel with filtering system construction in accordance with the present invention and mounted on a 55 gallon drum.
Figure 2:
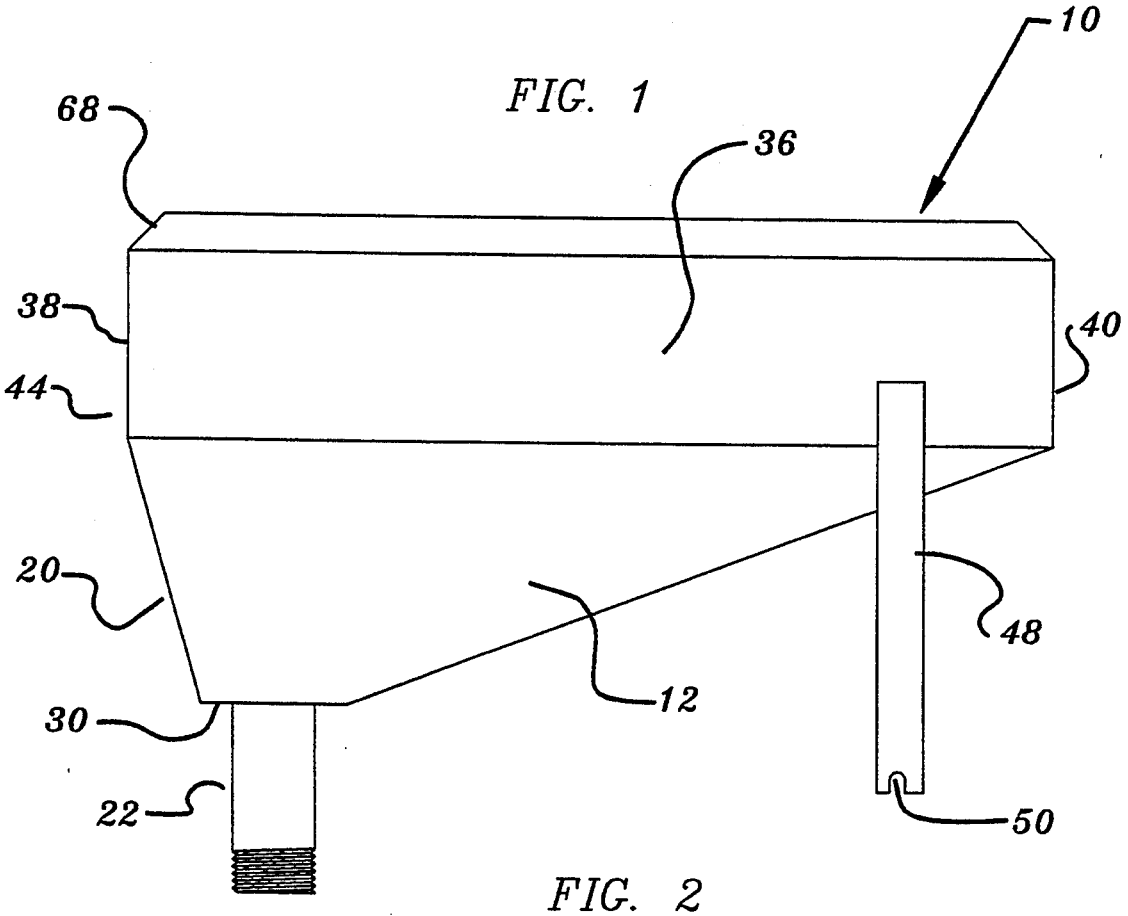
FIG. 2 is an enlarged side elevational view of the oil funnel with filtering system as shown in FIG. 1.
Figure 3:
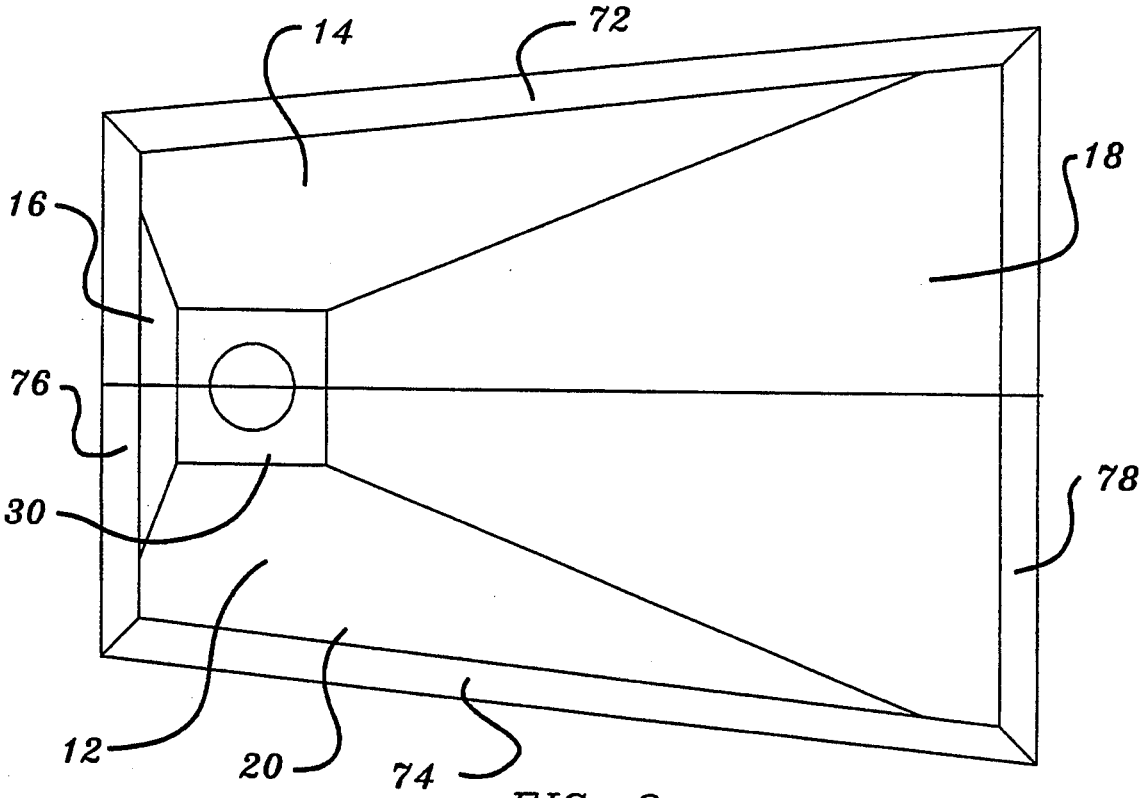
FIG. 3 is a elevational view of the oil funnel of the prior figures but with the filtering system removed for illustrating the components therebeneath.
Figure 4:
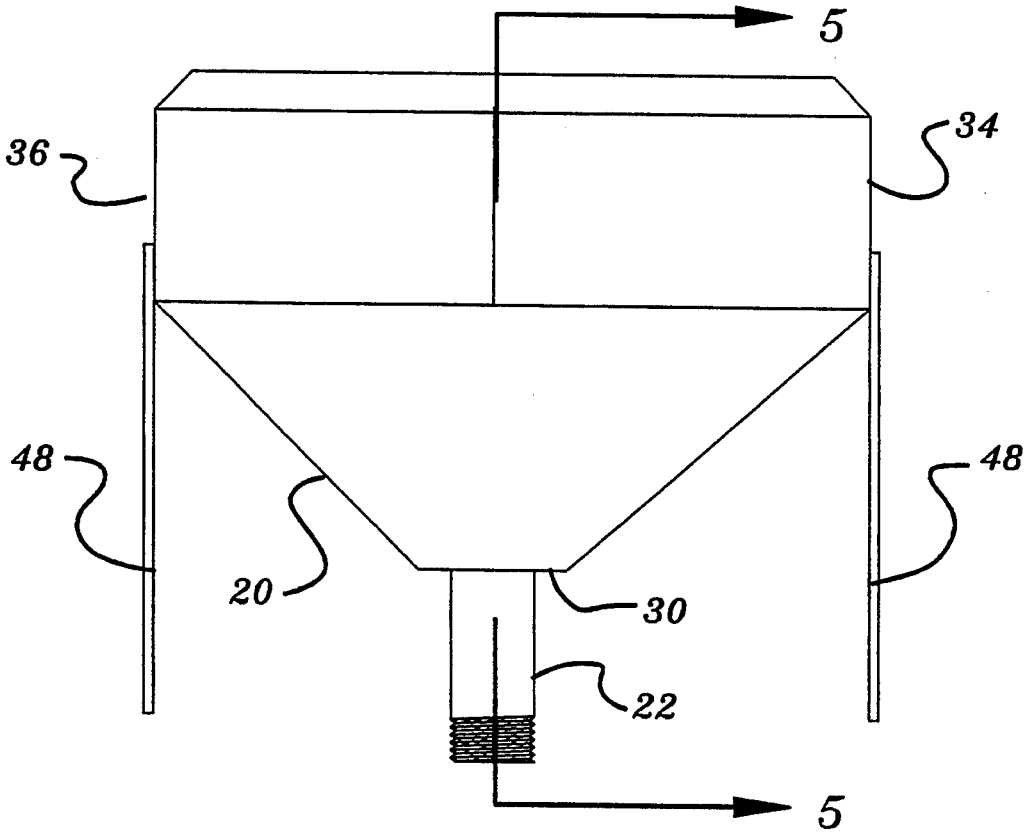
FIG. 4 is a side elevational view of the oil funnel with filtering system of the prior figures.
Figure 5:
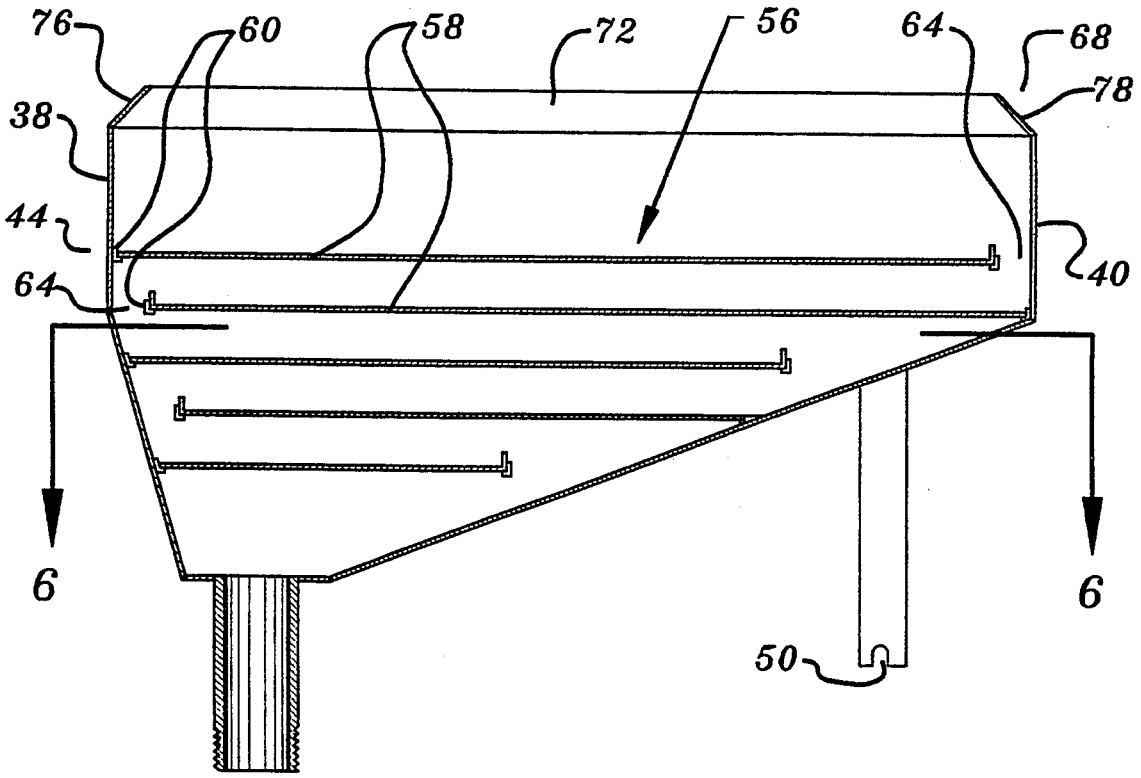
FIG. 5 is cross sectional view of the oil funnel with filtering system of the prior figures taken along line 5—5 of FIG. 4.
Figure 6:
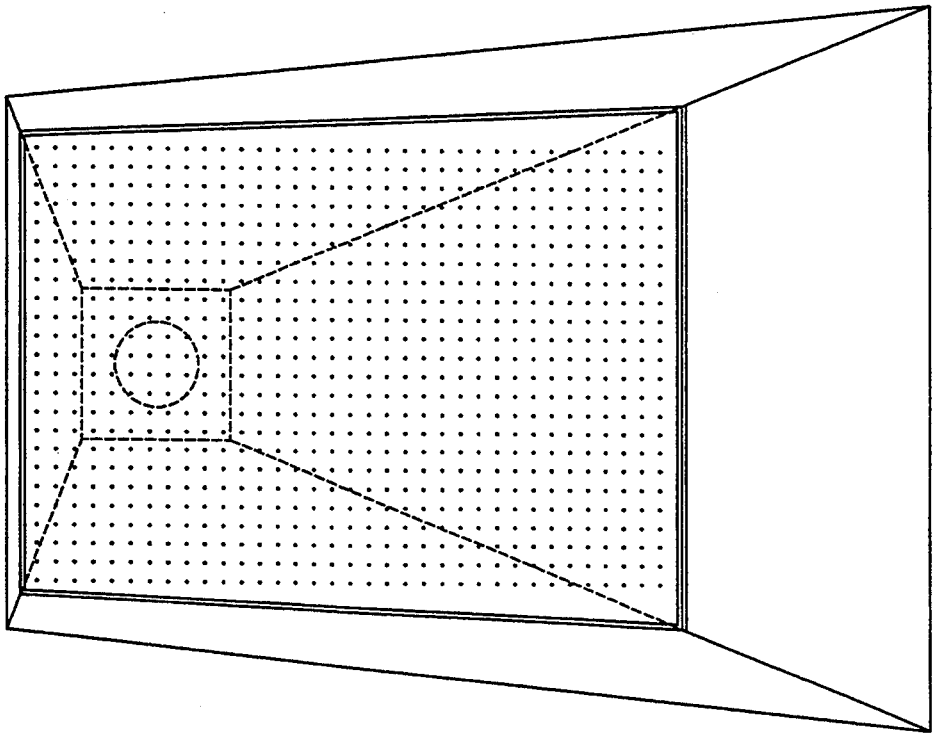
FIG. 6 is a sectional view of the oil funnel and filtering system of the prior figures taken along line 6—6 of FIG. 5.

With reference now to the drawings, and in particular to FIG. 1 thereof, a new and improved oil funnel with filter system embodying the principles and concepts of the present invention and generally designated by the reference numeral 10 will be described.

More specifically, it will be noted with respect to FIGS. 1 thru 6 in particular, that the oil funnel with filtering system 10, includes an apparatus for funneling and filtering waste oil. The apparatus is for funneling waste oil into a 55 gallon drum and for filtering particulant matter from such oil. The apparatus comprises, in combination, four trapezoidal sidewalls, 12, 14, 16 and 18. Each trapezoidal sidewall has an upper edge, a lower edge and side edges. Two opposed trapezoidal sidewalls, 12 and 14 are of a similar configuration. The remaining two opposed trapezoidal sidewalls constituting a large trapezoidal sidewall 18 and a small trapezoidal sidewall 16. Welding couples the side edges of the four trapezoidal sidewalls to form a nonsymmetric truncated pyramid 20 having a vertical axis.

A drain pipe, 22 has a circular cross-section with a vertical axis coincident with the axis of the pyramid. The drain pipe 22 has a lower end with external threads for coupling with an opening of a 55 gallon drum 26. The drain pipe has an upper end. A coupling plate 30 having a circular opening in the center thereof with welding coupling the opening to the upper end of the drain pipe. The coupling plate has a rectangular periphery with welding coupling the periphery to the lower edges of the pyramid 20.

Four rectangular sidewalls 34, 36, 38 and 40 are also provided. Each rectangular sidewall having an upper edge, lower edge and side edges. Two opposed rectangular side walls 34 and 36 are of a similar configuration. The remaining two opposed rectangular sidewalls constitute a large rectangular sidewall 40 and a small rectangular sidewall 38 with welding coupling the lowered edges of the four rectangular sidewalls to the upper edges of the truncated sidewalls. Welding coupling the side edges of the four rectangular sidewalls to thereby form an upper extension 44 of the pyramid 20.

Vertically extending support rods 48 is coupled to and depending from sidewalls 36 adjacent to a region of the large trapezoidal sidewall 18 remote from the drain pipe 22. The lower edge of the support rod 48 terminates in notches 50 at the lower end thereof. The notches 50 functions for positioning over the peripheral flange of a 55 gallon drum. The notches 50 are located at an elevational location above the threads at the lower end of the drain pipe (note FIG. 2.)

A screen 56 is removable received within the apparatus to filter out particulant matter poured through the filter into the 55 gallon drum. The screen 56 is a system of parallel vertically disposed plates 58 with apertures and with support brackets 60 extending across the opening formed by the rectangular side walls and trapezoidal side walls. The brackets forming openings 64 at the end thereof for a back and forth passageway of the oil from the upper end of the apparatus to the lower end thereof.

The apparatus further includes a splash guard 68 extending upwardly from the upper edges of the rectangular side walls, splash guard being formed of four trapezoidal side walls, 72, 74, 76 and 78. Each sidewall has an upper edge, lower edge and side edges with the lower edges thereof welded to the upper edges of the rectangular side walls and with the side edges thereof coupled to form a truncated pyramid with the upper edges thereof forming an area less than the area of the lower edges thereof.

Figure 7:
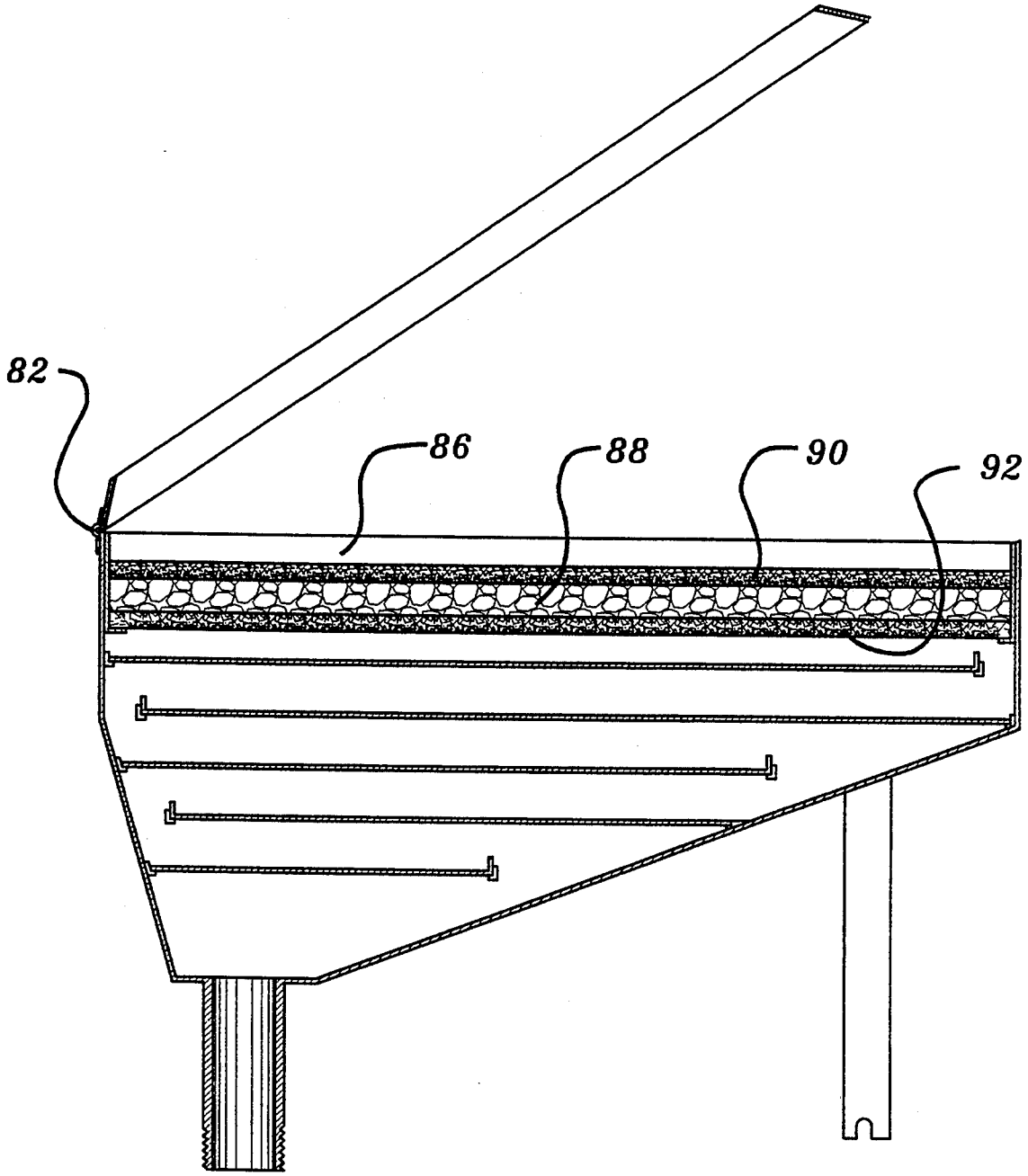
FIG. 7 is a cross sectional view similar to FIG. 5 of an oil funnel with filtering system but constructed in accordance with an alternate embodiment of the invention.

In an alternate embodiment of the invention, as shown in FIG. 7, the apparatus includes upper edges of the rectangular side walls which are coupled from the lower edges of the upper truncated pyramid with a hinge 82 along one edge for the pivoting of the upper truncated pyramid away from the upper extension 44.

A further feature of the FIG. 7 embodiment of the use of a supplemental filter 86 located within the upper extent of the rectangular upper extension 44. Such filter 80 includes replaceable filter media 88 supported between upper and lower plates 90 and 92 through which the waste oil to be funnelled and filtered may pass. This adds further purity to the oil received in the drum.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An apparatus for funneling waste oil into a drum and for filtering particulant matter from such oil comprising, in combination:

four trapezoidal sidewalls, each trapezoidal sidewall having an upper edge, a lower edge and side edges, two opposed trapezoidal sidewalls being of a similar configuration, the remaining two opposed trapezoidal sidewalls constituting a large trapezoidal sidewall and a small trapezoidal sidewall, the side edges of the four trapezoidal sidewalls coupled to form a non-symmetric truncated pyramid having a vertical axis;

a drain pipe having a circular cross-section with a vertical axis coincident with the axis of the pyramid, the drain pipe having a lower end with external threads for coupling with an opening of a drum, the drain pipe having an upper end;

a coupling plate having a circular opening in the center thereof with means coupling the opening to the upper end of the drain pipe, the coupling plate having a rectangular periphery coupled to the lower edges of the pyramid;

four rectangular sidewalls, each rectangular sidewall having an upper edge, a lower edge and side edges, two opposed rectangular side walls being of a similar configuration, the remaining two opposed rectangular sidewalls constituting a large rectangular sidewall and a small rectangular sidewall with the lower edges of the four rectangular sidewalls coupled to the upper edges of the truncated sidewalls and the side edges of the four rectangular sidewalls coupled to thereby form an extension of the pyramid, vertically extending support means depending from the apparatus sidewall having notches for positioning over the peripheral flange of a drum;

a splash guard extending upwardly from the upper edges of the rectangular sidewalls, the splash guard being formed of four trapezoidal side walls, each having an upper edge, a lower edge and side edges with the lower edges having hinges thereon, the hinges thereof pivotally coupled to the upper edges of the rectangular side walls and with the side edges thereof coupled to form an upper truncated pyramid with the upper edges thereof forming an area less than the area of the lower edges thereof; and a filter supported within the apparatus.

2. The apparatus as set forth in claim 1 wherein the filter is a filtering means with replaceable media located within the upper extent of the rectangular side walls.

* * * * *